US009533842B1

(12) United States Patent
Belarmino et al.

(10) Patent No.: US 9,533,842 B1
(45) Date of Patent: Jan. 3, 2017

(54) SYSTEMS FOR SENSING SHEET RESTRAINT POSITION

(71) Applicant: Lexmark International, Inc., Lexington, KY (US)

(72) Inventors: Genri Solano Belarmino, Cebu (PH); Dustin Daniel Fichter, Versailles, KY (US); Neal Douglas McFarland, Versailles, KY (US); Stacey Vaughan Mitchell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/168,929

(22) Filed: May 31, 2016

(51) Int. Cl.
*B65H 1/04* (2006.01)

(52) U.S. Cl.
CPC ..... *B65H 1/04* (2013.01); *B65H 2405/1116* (2013.01); *B65H 2405/11161* (2013.01); *B65H 2405/31* (2013.01); *B65H 2405/32* (2013.01); *B65H 2511/10* (2013.01); *B65H 2511/11* (2013.01); *B65H 2511/12* (2013.01); *B65H 2553/20* (2013.01); *B65H 2553/21* (2013.01)

(58) Field of Classification Search
CPC ..... B65H 1/04; B65H 2405/1116; B65H 2405/11161; B65H 2405/31; B65H 2405/32; B65H 2511/10; B65H 2511/11; B65H 2511/12; B65H 2553/21; B65H 2553/20
USPC ..... 271/171
See application file for complete search history.

(56) References Cited

U.S. PATENT DOCUMENTS

| | | | | |
|---|---|---|---|---|
| 5,332,208 | A * | 7/1994 | Tsuji | B65H 1/00 271/171 |
| 5,940,106 | A * | 8/1999 | Walker | B41J 2/01 271/171 |
| 6,254,085 | B1 * | 7/2001 | Kang | B65H 1/04 271/171 |
| 6,267,522 | B1 | 7/2001 | Slippy | |
| 6,901,820 | B2 | 6/2005 | Imahara | |
| 7,694,960 | B2 | 4/2010 | Sing | |
| 8,259,367 | B2 | 9/2012 | Wong | |
| 2004/0262835 | A1 * | 12/2004 | Leveto | B65H 1/04 271/223 |
| 2008/0036140 | A1 * | 2/2008 | Inoue | B65H 1/04 271/265.01 |
| 2008/0122163 | A1 * | 5/2008 | Windsor | B65H 1/04 271/154 |

* cited by examiner

*Primary Examiner* — David H Bollinger

(57) ABSTRACT

An imaging device having a sheet restraint sensing system is disclosed. The system includes a frame having an opening, a linear sensor strip located on the frame having a length, and a media tray having a sheet restraint that presses against the linear sensor strip when the media tray is located in the opening. The sheet restraint is constrained by the media tray to move relative to the media tray no more than a maximum adjustment displacement. The maximum adjustment displacement is less than the length of the linear sensor strip. Other systems are disclosed.

12 Claims, 4 Drawing Sheets

SYSTEMS FOR SENSING SHEET RESTRAINT POSITION

CROSS REFERENCES TO RELATED APPLICATIONS

None.

BACKGROUND

1. Field of the Disclosure

The present disclosure relates generally to media trays for imaging devices and more particularly to sensing the position of a sheet restraint in a media tray.

2. Description of the Related Art

Imaging devices, such as laser printers, form images on sheets of media. The media is stacked in media trays. Media is available in multiple widths and lengths, and many media trays have user-adjustable sheet restraints to accommodate this variation.

It is helpful for the imaging device to know the size of the media so that, for example, the print job may be correctly sized to fit on the media. Existing sheet restraint sensing systems use optical sensors or electrical contact sensors that may fail due to accumulated paper dust. What is needed is a sheet restraint sensing system that is robust against contamination by paper dust.

SUMMARY

The invention, in one form thereof, is directed to an imaging device having a frame having an opening; a sensor strip attached to the frame having a longitudinal axis; a media tray located in the opening configured to hold a stack of sheets of media; and a sheet restraint attached to the media tray configured to move along a linear adjustment path to adjust a maximum sheet dimension accommodated by the media tray. The sheet restraint presses against the sensor strip at a point of contact, the longitudinal axis of the sensor strip is parallel to the linear adjustment path, and the sensor strip is non-conductive at the point of contact.

The invention, in another form thereof, is directed to an imaging device having a frame having an opening having an interior surface; a linear sensor strip located on the interior surface having an output resistance; and a media tray having a sheet restraint that presses against the linear sensor strip when the media tray is located in the opening. The output resistance is proportional to a position of the sheet restraint.

The invention, in yet another form thereof, is directed to an imaging device having a frame having an opening; a linear sensor strip located on the frame having a length; and a media tray having a sheet restraint that presses against the linear sensor strip when the media tray is located in the opening. The sheet restraint is constrained by the media tray to move relative to the media tray no more than a maximum adjustment displacement. The maximum adjustment displacement is less than the length of the linear sensor strip.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
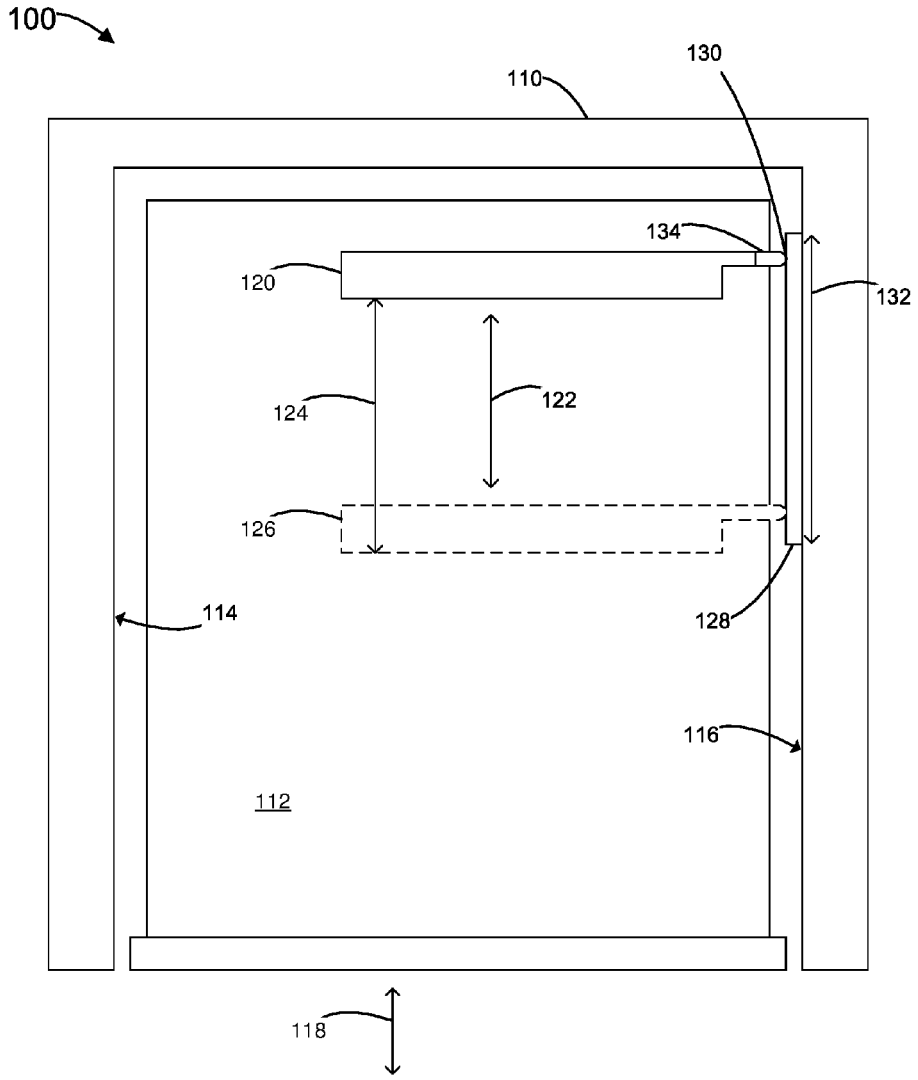
FIG. 1 is a block diagram of a top view of a portion of an imaging device.

Referring to the drawings and particularly to FIG. 1, there is shown a block diagram depiction of a top view of a portion of an imaging device 100 according to one example embodiment. Imaging device 100 includes a frame 110 having an opening configured to accept a media tray 112. The media tray 112 has side rails that ride along mating rails located on left 114 and right 116 interior surfaces of the opening and thus the media tray 112 is configured to open and close by moving along a linear insertion path 118. The media tray 112 holds a stack of sheets of media to be imaged on by the imaging device 100 as is known in the art. The media tray 112 may be removed from the imaging device 100 by a user without the use of tools. Alternatively, the media tray 112 may be captive and the user may pull the media tray out to a maximum extended position before hitting the limit of travel.

The media tray 112 is configured to accommodate varying sizes of media for example 8.5"×11" (letter), 8.5"×14" (legal), etc. A sheet restraint 120 is attached to the media tray 112 and is configured to move along a linear adjustment path 122 to adjust a maximum sheet dimension accommodated by the media tray for example sheet width or sheet length. The maximum adjustment displacement 124 is the distance between the sheet restraint 120 located at the maximum sheet dimension position (shown in solid lines) and the minimum sheet dimension position 126 (shown in dashed lines). The sheet restraint 120 is configured to be manually positioned by a user along the linear adjustment path 122.

The sheet restraint 120 presses against a sensor strip 128 at a point of contact 130. The sensor strip 128 has an output that corresponds to the location of the point of contact 130. Thus, the imaging device 100 may measure this output to determine the position of the sheet restraint 120 and thus determine the corresponding sheet dimension. The sensor strip 128 has a length 132 that is preferably longer than the maximum adjustment displacement 124 so that the sheet restraint 120 contacts the sensor strip 128 regardless of the position of the sheet restraint 120 along the linear adjustment path 122.

The sheet restraint 120 may have a wiper 134 configured to travel perpendicular to the linear adjustment path 122 and to press against the sensor strip 128 at the point of contact 130. Preferably, the wiper 134 is spring loaded to compensate for manufacturing variability in the distance between the sheet restraint 120 and the sensor strip 128 while providing sufficient force at the point of contact 130 to reliably activate the sensor strip 128. Preferably, the force is at least one newton.

Figure 2:
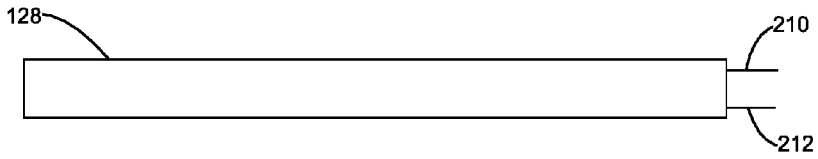
FIG. 2 is a block diagram of a side view of a sensor strip.

FIG. 2 shows a side view of the sensor strip 128. The sensor strip 128 has a first terminal 210 and a second terminal 212. The electrical resistance between these terminals varies continuously as the point of contact moves along the longitudinal axis of the sensor strip 128. Thus, the sensor strip 128 is a linear sensor strip with a continuous output. Alternatively, the electrical resistance may vary in discrete steps as the point of contact moves from segment to segment of the sensor strip 128 if, for example, the sensor strip is subdivided into segments. It is preferable for the resistance to vary continuously to avoid errors caused by measuring near a discontinuity. Also, a continuous output enables the system to discriminate between a much larger media set than an output broken into discrete segments. The sensor strip is non-conductive at the point of contact and thus the sensor strip 128 is resistant to paper dust and other contaminants that may accumulate on the surface of the sensor strip 128. In this example, electrical current does not flow from the sensor strip 128 to the wiper 134 and thus this system is more robust than electrical-contact based sensor systems. As used here, a material is non-conductive if its resistivity is greater than the resistivity of silicon i.e. greater than one ohm meter.

Figure 3:
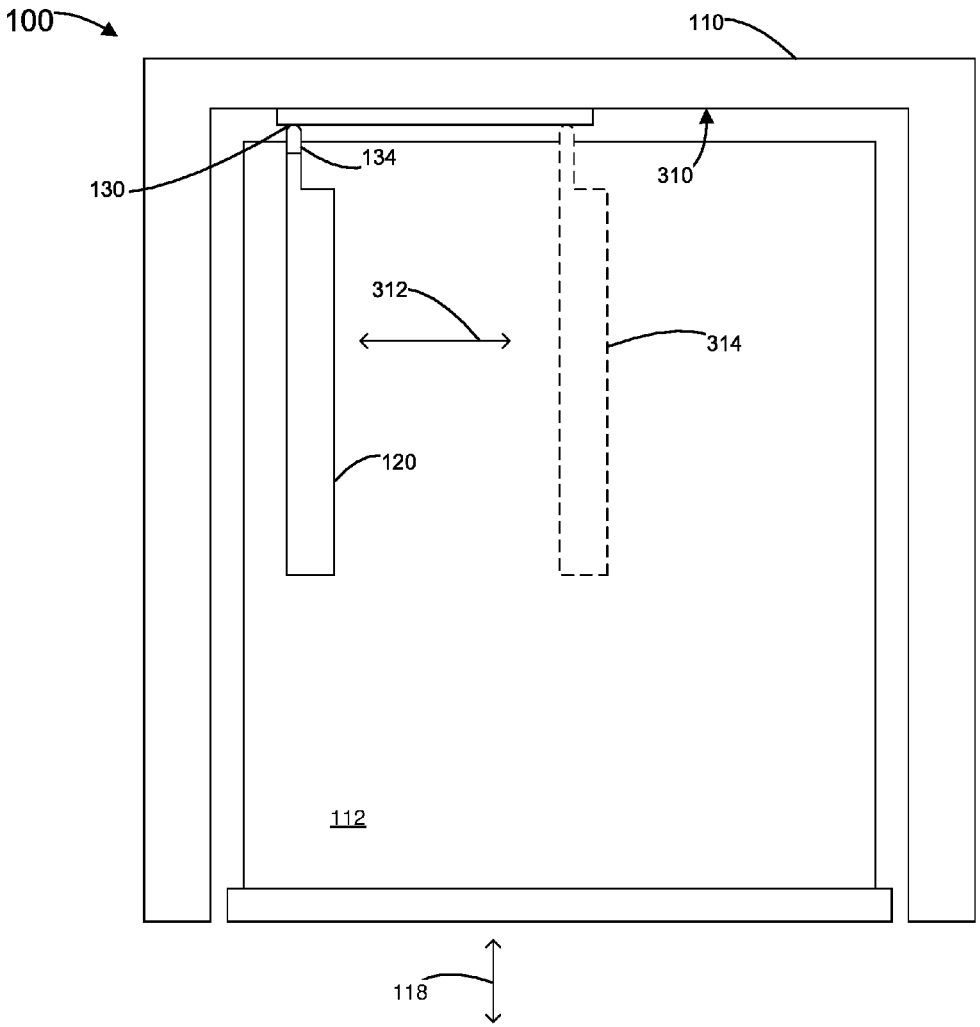
FIG. 3 is a block diagram of a top view of a portion of an imaging device.

FIG. 3 shows a block diagram depiction of a top view of a portion of the imaging device 100 according to an example embodiment. The sensor strip 128 is located on a rear 310 interior surface of the opening in the frame 110. The wiper 134 contacts the sensor strip 128 at the point of contact 130. The sheet restraint 120 is configured to move between a first position, shown in solid lines, and a second position 314, shown in dashed lines, by moving along a linear adjustment path 312 that is perpendicular to the linear insertion path 118 of the media tray 112. Alternatively, the sensor strip may be located above, below, or to the left of the media tray with a mating wiper polarity. A slot in the media tray may be needed for the wiper to contact a sensor strip located below the media tray.

Figure 4:
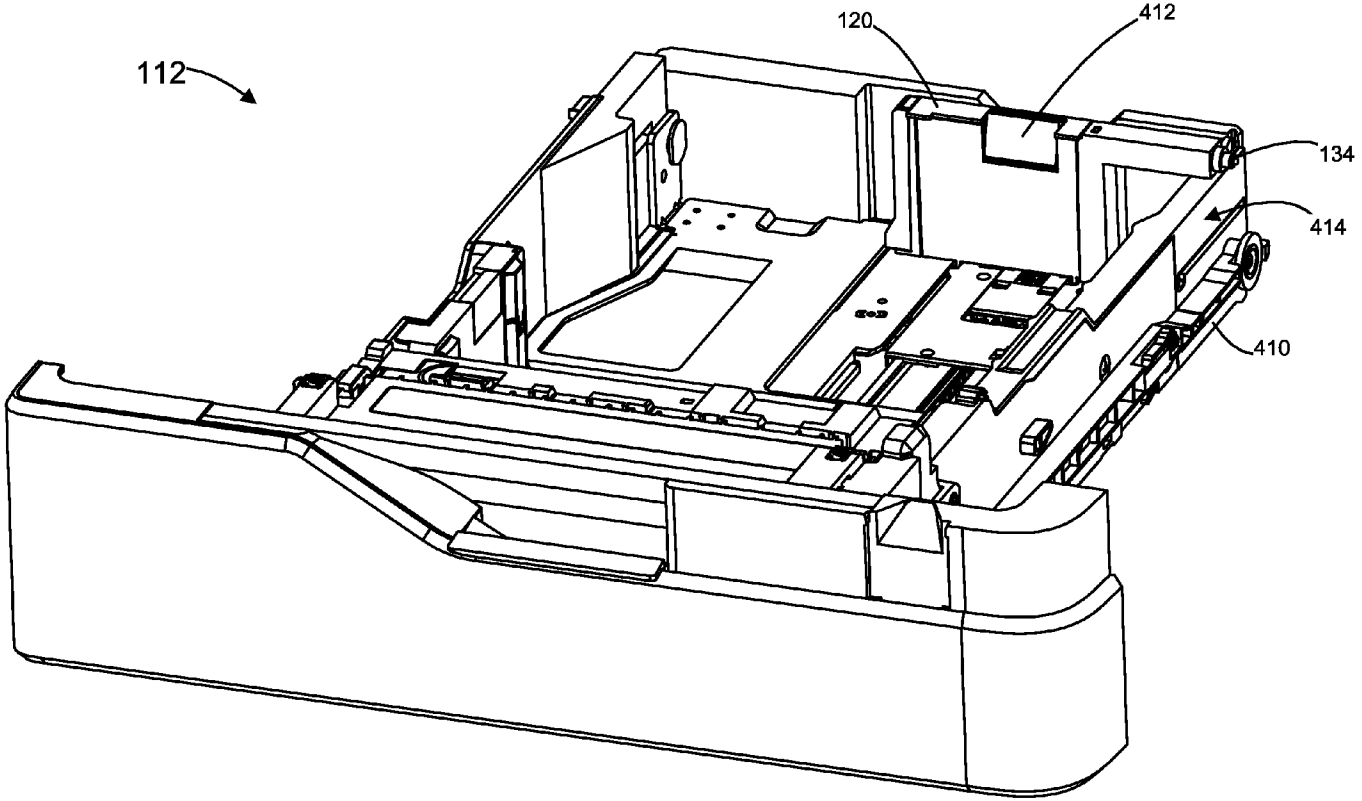
FIG. 4 is an isometric view of a media tray.

FIG. 4 shows an isometric view of a media tray 112 according to an example embodiment. The media tray 112 has side rails 410 located on the left and right sides. A sheet restraint 120 is configured to be adjusted by a user pressing a release lever 412 and moving the sheet restraint 120 relative to the media tray 112. The sheet restraint 120 has a wiper 134 that extends past a side wall 414 of the media tray 112.

Figure 5:
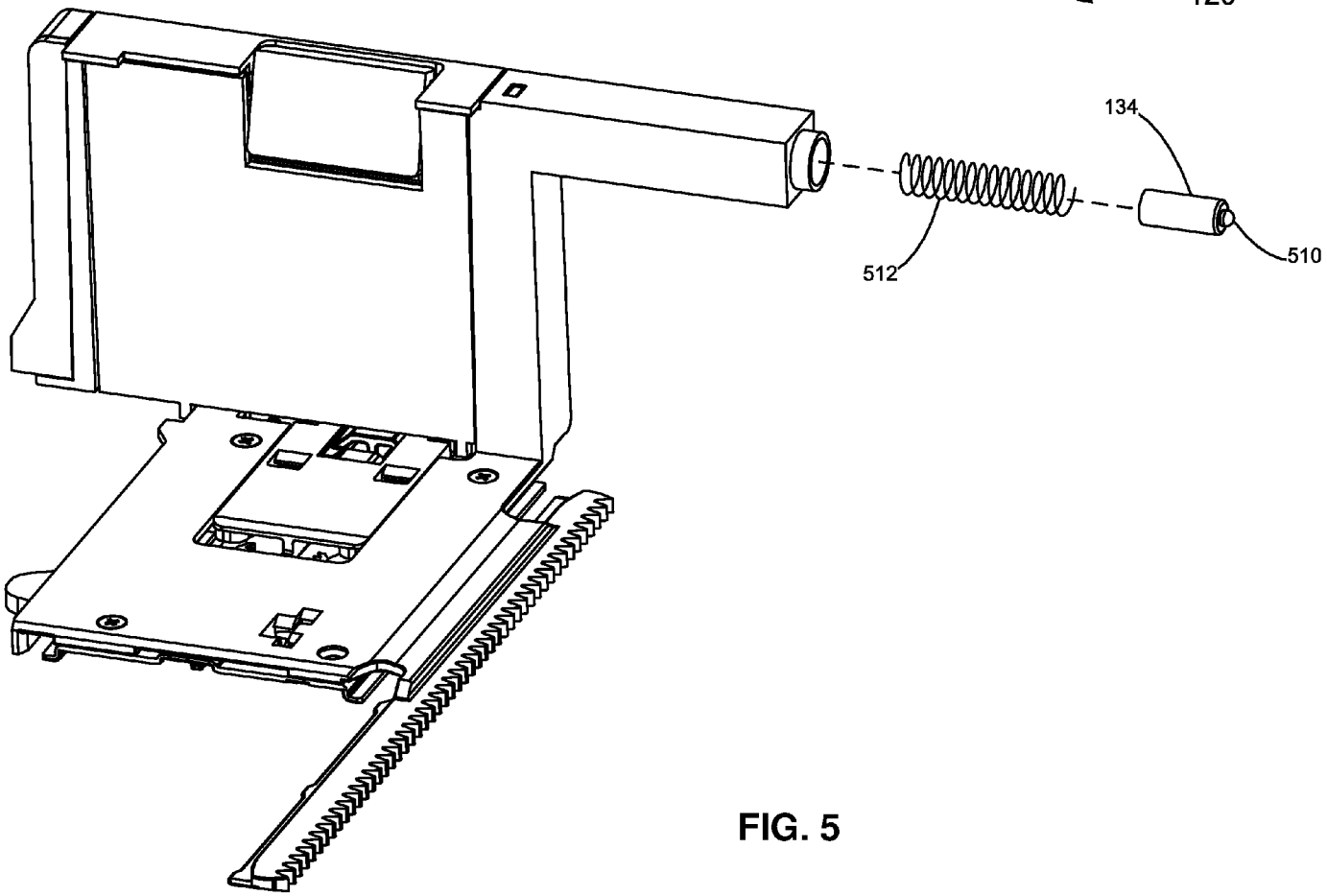
FIG. 5 is an isometric exploded view of a sheet restraint.

FIG. 5 shows an isometric exploded view of the sheet restraint 120. The wiper 134 has a rounded tip 510 to avoid wear on the sensor strip 128. The wiper 134 is biased by a spring 512 to provide sufficient force at the point of contact 130 to reliably activate the sensor strip 128.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. An imaging device comprising:

a frame having an opening;

a sensor strip attached to the frame having a longitudinal axis;

a media tray located in the opening configured to hold a stack of sheets of media; and a sheet restraint attached to the media tray configured to move along a linear adjustment path to adjust a maximum sheet dimension accommodated by the media tray;

wherein the sheet restraint presses against the sensor strip at a point of contact, the longitudinal axis of the sensor strip is parallel to the linear adjustment path, and the sensor strip is non-conductive at the point of contact.

2. The imaging device of claim 1, wherein the maximum sheet dimension is sheet width.

3. The imaging device of claim 1, wherein the maximum sheet dimension is sheet length.

4. The imaging device of claim 1, wherein the media tray is removable from the frame without the use of tools.

5. The imaging device of claim 1, wherein the sheet restraint includes a spring that provides a force at the point of contact.

6. The imaging device of claim 5, wherein the force is at least one newton.

7. The imaging device of claim 1, wherein the sheet restraint includes a wiper configured to travel perpendicular to the linear adjustment path and to press against the sensor strip at the point of contact.

8. The imaging device of claim 7, wherein the wiper is spring loaded.

9. The imaging device of claim 1, wherein the media tray is configured to open and close by moving along a linear insertion path and the longitudinal axis of the sensor strip is parallel to the linear insertion path.

10. The imaging device of claim 1, wherein the sensor strip has a first terminal and a second terminal and an electrical resistance between the first terminal and the second terminal varies continuously as the point of contact moves along the longitudinal axis of the sensor strip.

11. An imaging device comprising:

a frame having an opening having an interior surface;

a linear sensor strip located on the interior surface having an output resistance; and a media tray having a sheet restraint that presses against the linear sensor strip when the media tray is located in the opening;

wherein the output resistance is proportional to a position of the sheet restraint.

12. An imaging device comprising:

a frame having an opening;

a linear sensor strip located on the frame having a length; and a media tray having a sheet restraint that presses against the linear sensor strip when the media tray is located in the opening, the sheet restraint is constrained by the media tray to move relative to the media tray no more than a maximum adjustment displacement;

wherein the maximum adjustment displacement is less than the length of the linear sensor strip.

* * * * *